US006712229B2

(12) United States Patent
Fritsche et al.

(10) Patent No.: US 6,712,229 B2
(45) Date of Patent: Mar. 30, 2004

(54) DISPLAY WITH APPURTENANCE ATTACHMENT SYSTEM

(75) Inventors: Mark Fritsche, Eagan, MN (US); Dan Berg, Minneapolis, MN (US); Jason Johnson, Minneapolis, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

(21) Appl. No.: 09/953,098

(22) Filed: Sep. 13, 2001

(65) Prior Publication Data

US 2003/0205546 A1 Nov. 6, 2003

(51) Int. Cl.[7] ..... A47B 47/00

(52) U.S. Cl. ..... 211/189; 211/192; 211/103; 211/207

(58) Field of Search ..... 211/189, 192, 211/193, 190, 207, 103, 187; 52/474; 248/206.5, 218.4, 220.21, 222.52; 312/265.5, 257.1, 265.4; 108/93, 106, 107, 108, 110, 144.11, 147.11, 147.12, 147.15, 147.17

(56) References Cited

U.S. PATENT DOCUMENTS 3,483,998 A * 12/1969 Butler ..... 211/189
3,606,027 A * 9/1971 Clements ..... 211/191
3,983,823 A * 10/1976 McDonnell ..... 108/147.11

(List continued on next page.)

FOREIGN PATENT DOCUMENTS

CA 1048970 * 2/1979 ..... 211/189

OTHER PUBLICATIONS

Skyline Displays, Inc., *ps2000 brochure*, 2001.
Skyline Displays, Inc., *imagine that. brochure*, 2000.
Skyline Displays, Inc., *design ideas brochure*, 2000.
Skyline Displays, Inc., *How Do You Market Your e–Business Offline? brochure*, 2001.
Skyline Displays, Inc., *mirage plus brochure*, 2001.
Skyline Displays, Inc., *skytruss brochure*, 2001.
Trussworks, Truss Catalog web page printout, *Truss Parts*, Aug. 17, 2001.
Trussworks, Truss Catalog web page printout, *Trussworks Photos, Graphics Frame*, p. 1, Aug. 17, 2001.
Trussworks, Truss Catalog web page printout, *Trussworks Photos, Graphics Frame*, p. 2, Aug. 17, 2001.
Trussworks, Truss Catalog web page printout, *Trussworks Photos, Exhibit Photos*, p. 1, Aug. 17, 2001.
Trussworks, Truss Catalog web page printout, *Trussworks Photos, Graphics Frame*, p. 12 Aug. 17, 2001.

*Primary Examiner*—Daniel P. Stodola
*Assistant Examiner*—Jennifer E. Novosad
(74) *Attorney, Agent, or Firm*—Patterson, Thuente, Skaar & Christensen, P.A.

(57) ABSTRACT

The frame attachment system is a unitary-bodied frame attachment member being selectively and removably attachable to a vertical column member for attaching shelving brackets, and attachments of the like. The frame attachment system essentially includes three portions: a bracing portion, a grasping portion, and a slot portion. The grasping portion is substantially u-shaped for attachment around the vertical column member with the bracing portion being in perpendicular opposition to the grasping portion. The slot portion is proximate the bracing portion and includes a plurality of slots capable of receiving shelving brackets such that the insertion of a shelving bracket results in the bracket flushly resting against the vertical column member and thus limiting movement of the frame attachment member. Various fasteners, such as a magnet, can be fixed to the inner surface of the grasping portion to better facilitate attachment of the grasping portion to the vertical column member prior to receipt of the shelving bracket.

7 Claims, 3 Drawing Sheets

U.S. PATENT DOCUMENTS 4,064,996 A * 12/1977 Shillum ..... 211/191
4,212,445 A * 7/1980 Hagen ..... 248/245
4,570,390 A * 2/1986 Wendt ..... 52/36.6
4,658,560 A 4/1987 Beaulieu ..... 52/646
4,934,858 A * 6/1990 Beaulieu ..... 211/192
5,123,550 A 6/1992 Nodskow et al. ..... 211/189
5,167,391 A * 12/1992 Simpson ..... 248/220.21
5,269,112 A 12/1993 Weinrub et al. ..... 52/646
5,370,249 A * 12/1994 Harvey et al. ..... 211/189
5,529,192 A * 6/1996 Conen et al. ..... 211/189
5,566,844 A * 10/1996 Bernardin ..... 211/189
5,607,070 A * 3/1997 Hellyer ..... 211/189
5,758,988 A * 6/1998 Theodorou ..... 403/331
5,769,247 A * 6/1998 Merl ..... 211/103
5,918,750 A * 7/1999 Jackson ..... 211/189
5,944,203 A * 8/1999 Vlah et al. ..... 211/189
D416,471 S * 11/1999 Wurdack ..... D8/363
6,029,832 A * 2/2000 Bastian ..... 211/189
6,164,467 A * 12/2000 DePottey et al. ..... 211/189
6,168,032 B1 * 1/2001 Merl ..... 211/59.2
6,206,212 B1 * 3/2001 Loew ..... 211/189
6,216,887 B1 * 4/2001 Soo ..... 211/85.7
6,349,837 B1 * 2/2002 Serban ..... 211/26
6,378,768 B1 * 4/2002 Belloise ..... 232/39
6,405,884 B1 * 6/2002 Dion ..... 211/189
6,422,523 B1 * 7/2002 Weshler ..... 248/222.52
2001/0050262 A1 * 12/2001 LaBruna, Jr. et al. .... 211/87.01
2002/0033372 A1 * 3/2002 Kellogg ..... 211/13.1
2002/0144966 A1 * 10/2002 Calleja ..... 211/183

* cited by examiner

DISPLAY WITH APPURTENANCE ATTACHMENT SYSTEM

FIELD OF THE INVENTION

The present invention relates to displays, and in particular, to a removably mountable attachment system for receiving hooked appurtenance brackets.

BACKGROUND OF THE INVENTION

In the construction of exhibit and display stands, it is a conventional practice to utilize various truss and frame structures to assist in erecting and configuring the walls that create the backdrop for a particular vendor's defined booth space. Typically, frame and truss structures are designed so that they are readily disassemblable and collapsible for transportation to and from trade shows or other exhibitions.

Since these frame structures are collapsible and portable, nearly each component associated with these display stands must be separately detachable, including appurtenance such as shelving, and the brackets which are used to attach the appurtenances to various display frame segments. Conventional practice is to machine the surface of the frame structures with slots designed to removably receive the brackets. Consequently, in an attempt to provide numerous options in the mounting locations and configurations for appurtenances, the entire surface of each frame segment is generally slotted to accommodate hooked brackets.

This desire to provide multiple configuration options comes with obvious costs. First, only a limited number of these frame slots will actually be used to attach hooked brackets. However, since the manufacturer is incapable of knowing in advance the anticipated uses of each end user, each frame segment must be slotted so that the entire segment is hook-bracket-ready. This sort of inefficiency results in greatly increased manufacturing costs. Second, the machining of excessive slots is simply aesthetically unappealing. This can be a significant liability in the world of trade show displays where attractive eye-catching displays ultimately define success.

Consequently, there is a need for a frame attachment system which can be selectively coupled only to those segments of the framing structure where appurtenances are needed. In addition, such an attachment must be designed to reduce manufacturing costs and to increase the aesthetic appeal of the display stand.

SUMMARY OF THE INVENTION

A display has a plurality of vertical columns, with vertical frame members, a slotted C-shaped circumferential frame attachment member, and a hooked appurtenance bracket to engage with the slots of the attachment. The frame attachment member of the present invention is removably attachable to a vertical frame member for attaching shelving brackets, and brackets for other appurtenances. The frame attachment member essentially includes three portions, a bracing portion, a grasping portion, and a slot portion. The grasping portion is substantially u-shaped for attachment around a vertical frame member with the bracing portion being in perpendicular opposition to the grasping portion. The slot portion is proximate the bracing portion and includes a plurality of slots capable of receiving hooked brackets such that the insertion of a hooked bracket results in the bracket flushly resting against the vertical frame member and capturing the frame attachment member on the vertical frame member. Fastening means, such as a magnet, can be fixed to one of the inner surfaces of the grasping portion to better facilitate attachment of the grasping portion to the vertical frame member prior to receipt of the hooked bracket.

A significant feature and advantage of the present invention is that the frame attachment member is selectively and removably attachable to any vertical frame member. Consequently, multiple configuration options are made available to the end user. A frame attachment member can be utilized in only those areas where a specific configuration is desired. Furthermore, a specific vertical frame member can be targeted, with the present invention being attachable such that hooked brackets can be attached at varying angles on the targeted vertical frame member.

Another significant feature and advantage of the present invention is that it allows for more visually appealing display frame structures. The use of the selectively removable frame attachment members of the present invention eliminates the conventional need for machining unattractive slots into more vertical frame members than is needed.

A further feature and advantage of the present invention is that manufacturing costs are significantly reduced since it is no longer necessary to machine bracket slots into each vertical frame member.

Yet another feature and advantage of the present invention is that it can be constructed of thin sheet metal to reduce manufacturing costs. In addition, thinner sheet metal results in a lighter component to better facilitate portability.

A still further feature and advantage of the present invention is that it is capable of receiving commercially available hooked bracket accessories, such as those readily used in shelving.

Another feature and advantage of the present invention is that attachment to the display frame structure is done without tightly clasping or grasping onto the frame. As a result, scratching and other damage to the face of the outer surface of the vertical frame member is minimized.

The following U.S. Patent Applications are being filed by the same applicant on the same day as this application and are hereby incorporated by reference: U.S. patent application Ser. No. 09/953,099, entitled "SCREEN MOUNTING APPARATUS"; U.S. patent application Ser. No. 09/953,111, entitled "BOX FRAME ASSEMBLY"; U.S. patent application Ser. No. 09/953,113, entitled "MODULAR MULTI-CONFIGURABLE DISPLAY SYSTEM".

DETAILED DESCRIPTION OF THE PREFERRED EMBODIMENTS

Figure 1:
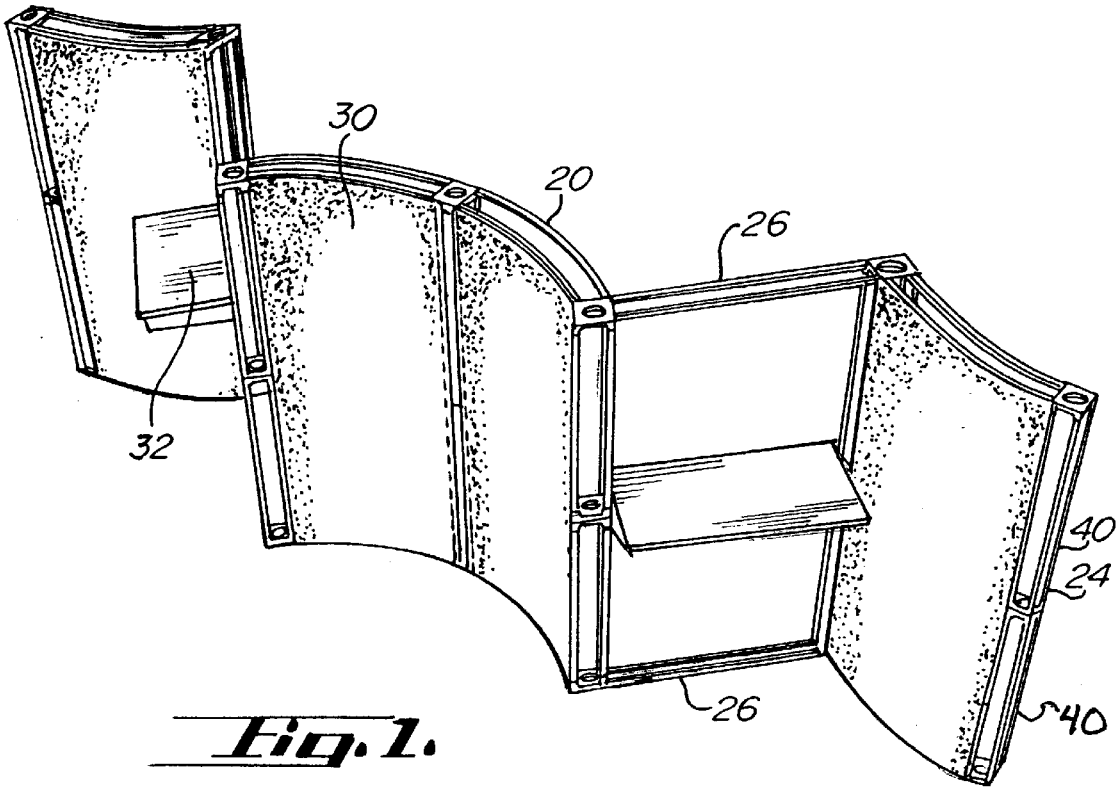
FIG. 1 is a perspective view of a display structure with frame attachment members and appurtenance brackets attached thereto in accordance with the invention.
Figure 2:
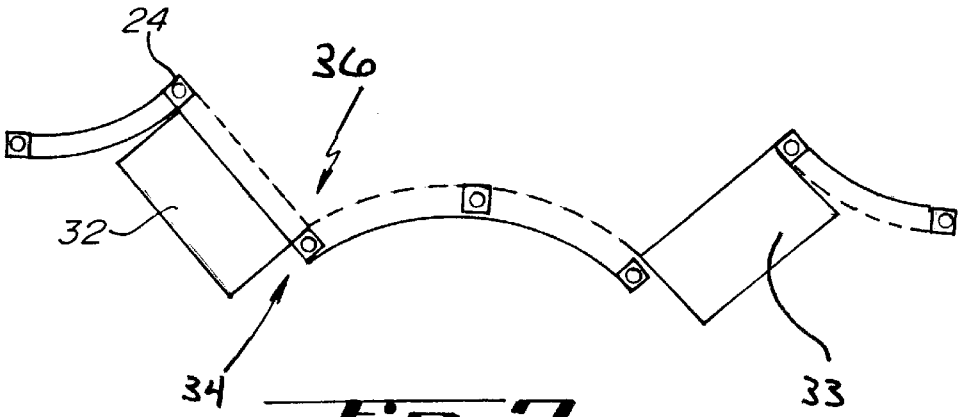
FIG. 2 is a top view of the display structure of FIG. 1.

Referring to FIG. 1, a portable disassemblable display structure 20 is shown which is intended for use at trade shows and specifically suitable for use as a back wall at such trade show exhibits. The display structure 20 comprises a plurality of vertical columns 24, a plurality of horizontal spanning members 26, screens 30, and appurtenances configured as shelves 32, 33. This display has a unique configuration as illustrated in FIG. 2 with the screens illustrated in heavy dark lines intermediate the vertical columns capable of being put on either the front 34 or the back 36 of the display 20. Moreover, the appurtenances configured as shelves 32, 33 have one shelf 32 extending from the front side of the display 20 in a forward direction, and another shelf 33 extending from the back side of the display 20 also in a forwardly direction.

Figure 3:
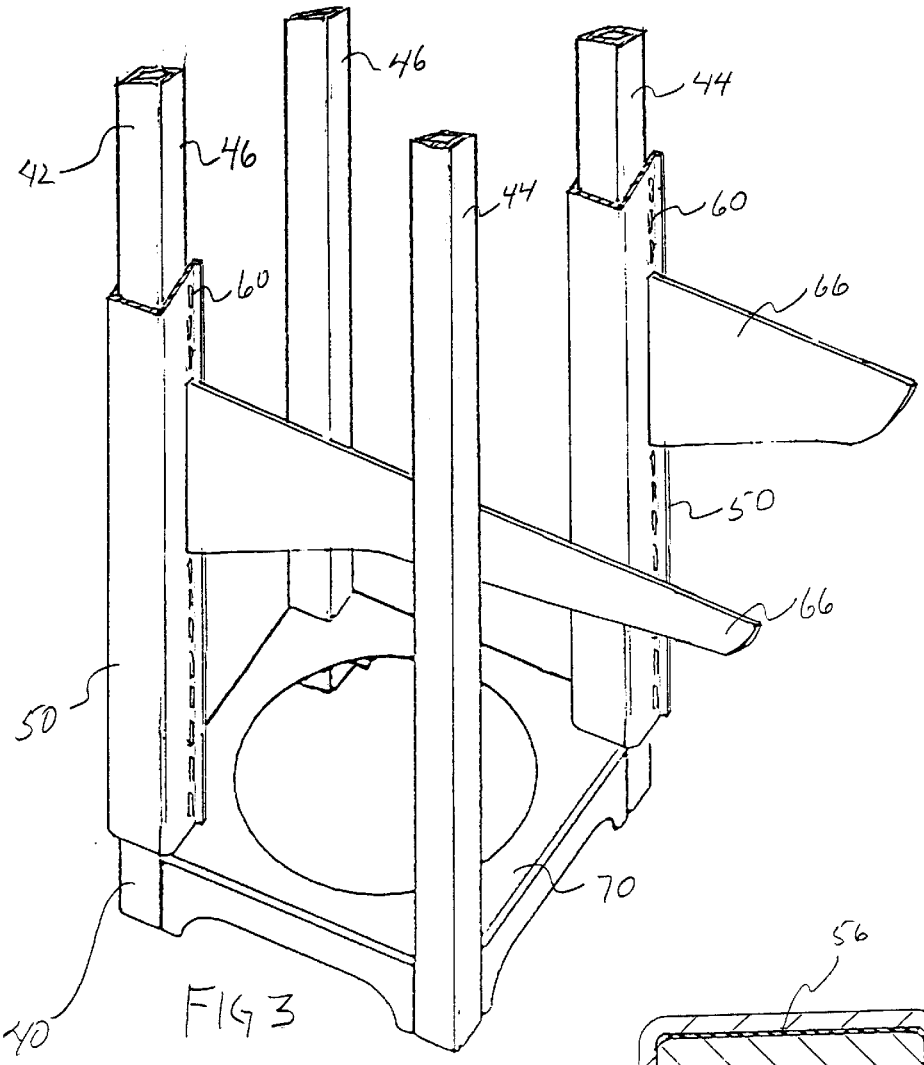
FIG. 3 is a Perspective view of a vertical column box unit.
Figure 7:
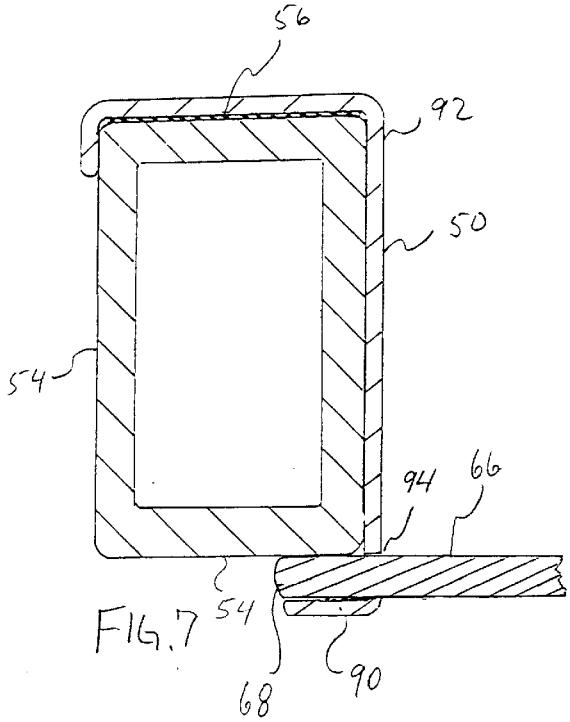
FIG. 7 is a top view of an embodiment of the attachment assembly.
Figure 4:
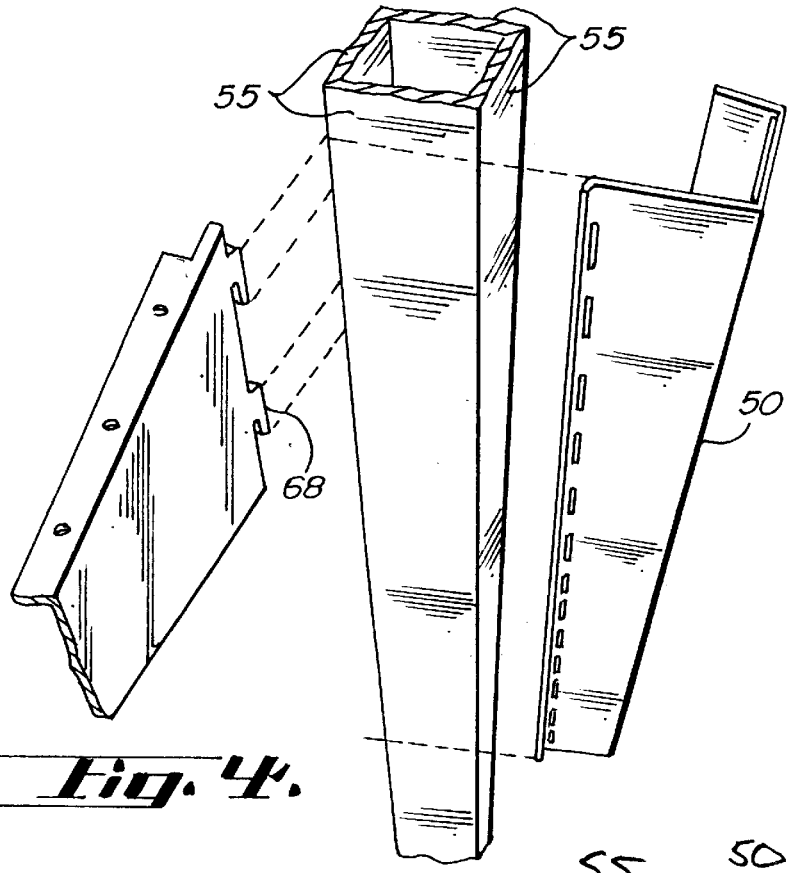
FIG. 4 is an exploded perspective view of an attachment assembly.
Figure 5:
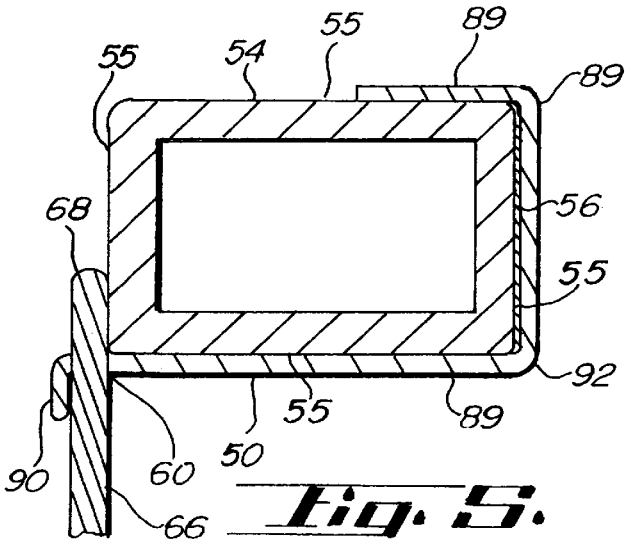
FIG. 5 is a sectional view of the attachment assembly taken at line 6—6 of FIG. 6.

Referring to FIGS. 3 through 7, effectuating the flexibility of attaching the appurtenance from the front side or the back side of the display 20 is the vertical column box unit 40 which has a plurality of vertical support members 42 which include a pair of front side members 44 and a pair of back side members 46. C-shaped circumferential frame attachment members 50 extend around four sides 54 of the vertical support member and are in an engagement relationship on three of the sides. Each of the sides 54 include a plurality of outwardly directed faces 55. A strip of magnetic material 56 may be adhesively attached to the frame attachment member to secure the frame attachment member to the vertical frame member. The frame attachment member has a plurality of vertically aligned slots 60 configured for receiving a hook bracket 66. The hook brackets 66 may be variously designed for support or securing appurtenance such as shelves, bars, tables, and the like. Insertion of the hooks 68 of the hooked appurtenance bracket 66 into the slots 60 of the frame attachment member 50 when the frame attachment member 50 is wrapped around and engaged with the vertical column effectively secure and captures the vertical column within the combination of the frame attachment member 50 and hooked appurtenance bracket 66. As illustrated in FIG. 3, the frame attachment member 50 may rest on a base 70 of the vertical columns or other means may be provided for vertically stabilizing the frame attachment member 50 to the vertical column. Such means includes the magnet strip 56 as illustrated in FIG. 7.

Figure 6:
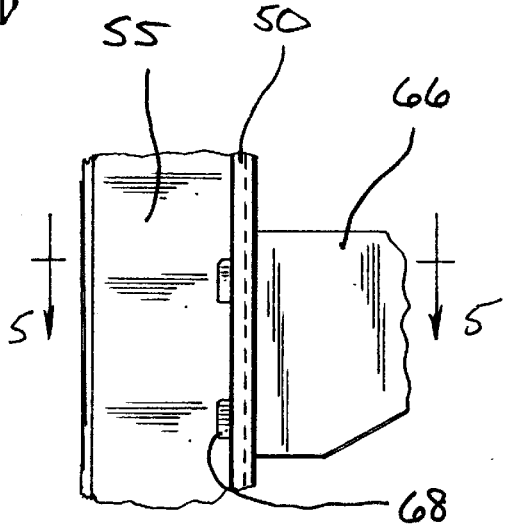
FIG. 6 is a side view of the attachment assembly.

The frame attachment member 50 comprises a bracing portion 90, a grasping portion 92, and a slot portion 94. The grasping portion 92 has three linear segments generally defining a J-shape. The bracing portion 90 provides stability to the hooked appurtenance bracket 66 and may extend in the direction as shown in FIG. 7, or in the opposite direction as shown in FIG. 6. The specification configuration as shown in FIG. 6 provides better protection from marring and scratching of the vertical frame member 54 in that the hooked appurtenance bracket 66 may be inserted at an angle into the slot 60 of the frame attachment member 50 at a slight angle such that there is no direct sliding or scraping contact between the hook portion 68 and the vertical frame member 54. That is to say, the hooked appurtenance bracket 66 may be rotated as shown in FIG. 6 in a slightly counterclockwise direction prior to insertion in the slot 60.

Although the strip of magnetic material 56 is illustrated on the interior surface of the J-shaped grasping portion opposite the slot, the magnetic material could be put on another inside surface location of the frame attachment member 50.

The attachment member 50 is preferably made of sheet metal with the slots punched therein and the sheet metal appropriately formed in the shape formed as illustrated. The hooked appurtenance brackets 66 may be conventional brackets as currently available for shelves and for mounting other appurtenances.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A portable disassemblable display structure comprising:

a plurality of vertical columns;

a plurality of horizontal spanning members connecting to the vertical columns;

a plurality of vertical screens supported by the vertical columns and horizontal spanning members, a shelf;

a frame attachment system for removably securing the shelf thereto, and wherein each vertical column comprises at least one vertical support member having a plurality of vertical, outwardly facing surfaces not having a plurality of slots, wherein the frame attachment system comprises a unitary-bodied selectively removable frame attachment member extending downwardly along said at least one vertical support member, said frame attachment member comprising:

a grasping portion having a plurality of vertical segments, the grasping portion being generally u-shaped for fitting substantially around the outwardly facing surfaces of the vertical support member;

a slot portion within one of the vertical segments, the slot portion having a plurality of vertically spaced aperture slots for receiving at least one hooked bracket such that an end of the at least one received hooked bracket is adapted to extend beyond the slot for limiting movement of the frame attachment member from the vertical support member; and a bracing portion in perpendicular opposition to the grasping portion for limiting movement of the received hooked bracket.

2. The portable disassemblable display structure of claim 1, further comprising a magnet fixedly attached to an inner surface of the grasping portion for securement of the grasping portion to the vertical support member.

3. The portable disassemblable display structure of claim 1, wherein the frame attachment member has a length generally equal to the length of one vertical support member for providing vertical stability.

4. The portable disassemblable display structure of claim 1, further comprising a base adapted to be attached to the vertical support members for vertically stabilizing the frame attachment member.

5. A frame attachment system for removably securing an appurtenance to a vertical support member in combination with the vertical support member, said vertical support member having a plurality of vertical, outwardly facing surfaces, said vertical surfaces not having vertical slots, the frame attachment system comprising:

a hooked bracket; and a unitary-bodied selectively removable frame attachment member having:

a grasping portion having a plurality of vertical segments, the grasping portion for fitting substantially around the vertical support member;

a slot portion having a plurality of vertically spaced aperture slots for receiving the hooked bracket such that an end of the received hooked bracket is adapted to extend beyond the slot for limiting movement of the frame attachment member with respect to the vertical support member; and a bracing portion in opposition to the grasping portion for limiting movement of the received hooked bracket.

6. A method of installing a frame attachment system comprising the steps of:

aligning a u-shaped frame attachment member defining an opening, such that the opening of the frame attachment member is in proximate alignment with a vertical support member, said vertical support member including a plurality of vertical, outwardly facing surfaces;

removably securing the frame attachment member to the vertical support member such that the frame attachment member substantially wraps around the vertical support member; and inserting a hooked shelf bracket into at least two slots on the frame attachment member such that an inserted end of the hooked shelf bracket stabilizes the securement of the frame attachment member against the vertical support member.

7. A method of installing a frame attachment apparatus to a vertical support member having a plurality of outwardly directed faces, the method comprising the steps of:

aligning a frame attachment apparatus having at least two vertical portions with at least two of the plurality of outwardly directed faces of the vertical support member, wherein at least one of the vertical portions includes a plurality of vertically spaced slots;

removably securing the frame attachment apparatus to the vertical support member such that at least one of the vertical portions of the frame attachment apparatus substantially confronts the vertical support member; and inserting a hooked bracket into at least one of the slots of the frame attachment apparatus such that an inserted end of the hooked bracket stabilizes the frame attachment apparatus against the vertical support member.

* * * * *